US006883357B1

(12) United States Patent
Cheng

(10) Patent No.: US 6,883,357 B1
(45) Date of Patent: Apr. 26, 2005

(54) INDICATING LOCK FOR A RIMLESS GLASS DOOR

(75) Inventor: Ko-Ming Cheng, Kaohsiung Hsien (TW)

(73) Assignee: Gang GWO Industrial Co., Ltd., (TW)

( * ) Notice: Subject to any disclaimer, the term of this patent is extended or adjusted under 35 U.S.C. 154(b) by 0 days.

(21) Appl. No.: 10/746,591

(22) Filed: Dec. 23, 2003

(51) Int. Cl.[7] ..... E05B 41/00

(52) U.S. Cl. ..... 70/432; 70/276; 70/77; 70/91; 70/DIG. 59; 292/251.5

(58) Field of Search ..... 70/432, 77–81, 70/91, 95, 99, 100, 101, 102, 104, 106, DIG. 59, 70/276; 292/251.5

(56) References Cited

U.S. PATENT DOCUMENTS 3,141,319 A * 7/1964 Schlage ..... 70/81
3,589,152 A * 6/1971 Glass et al. ..... 70/81
3,602,020 A * 8/1971 Kajita ..... 70/276
3,837,195 A * 9/1974 Pelto ..... 70/276
4,126,022 A * 11/1978 Bara Marco ..... 70/102
4,195,867 A * 4/1980 Baillie ..... 292/174
4,490,999 A * 1/1985 Castle et al. ..... 70/432
4,918,953 A * 4/1990 Newman ..... 70/131
5,301,988 A * 4/1994 Davenport et al. ..... 292/67
6,164,098 A * 12/2000 Hommes ..... 70/78

* cited by examiner

*Primary Examiner*—John B. Walsh
(74) *Attorney, Agent, or Firm*—Dellett & Walters

(57) ABSTRACT

An indicating lock for a rimless glass door is composed of a seat assembly, a driving member, a latching member, an indicating ring, and a clamping member. The seat assembly has an interior seat and an exterior seat. The driving member has an interior disk and an exterior disk. Multiple magnetic elements are installed in the interior disk and the exterior disk with opposite polarities. By using the magnetic force, the indicating lock can be securely and easily installed on a rimless glass door without cutting the glass of the door. An indicating ring is provided between the exterior disk and the exterior seat. Those outside the door can conveniently know whether the door is locked by observing the indicating ring.

9 Claims, 7 Drawing Sheets

INDICATING LOCK FOR A RIMLESS GLASS DOOR

BACKGROUND OF THE INVENTION

1. Field of the Invention

The present invention relates to an indicating lock for a rimless glass door, and more particularly to an indicating lock which does not involve cutting of the glass in order to the lock.

2. Description of Related Art

A first conventional lock for a rimless glass door can be installed on the rimless glass door without having to cut the glass, so it is very easy to install it. However, the first conventional lock does not have an indicating function, so those outside the glass door cannot know whether the door is locked unless they try opening the door.

A second conventional lock for the rimless glass door has a disk generally printed with two colors, such as blue and red. In a locked status, the red sectors of the disk can be seen from a slot of a panel of the lock; and in an unlocked status, the blue sectors of the disk can be seen from the slot. Thus, those outside the door can directly know whether the door is locked. However, the second conventional lock is provided with an axle extending through the door, so the glass door must be cut for installing the lock.

Therefore, the invention provides an indicating lock to mitigate or obviate the aforementioned problems.

SUMMARY OF THE INVENTION

The main objective of the present invention is to provide an indicating lock for a rimless glass door which does not involve cutting of the glass to install the lock.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
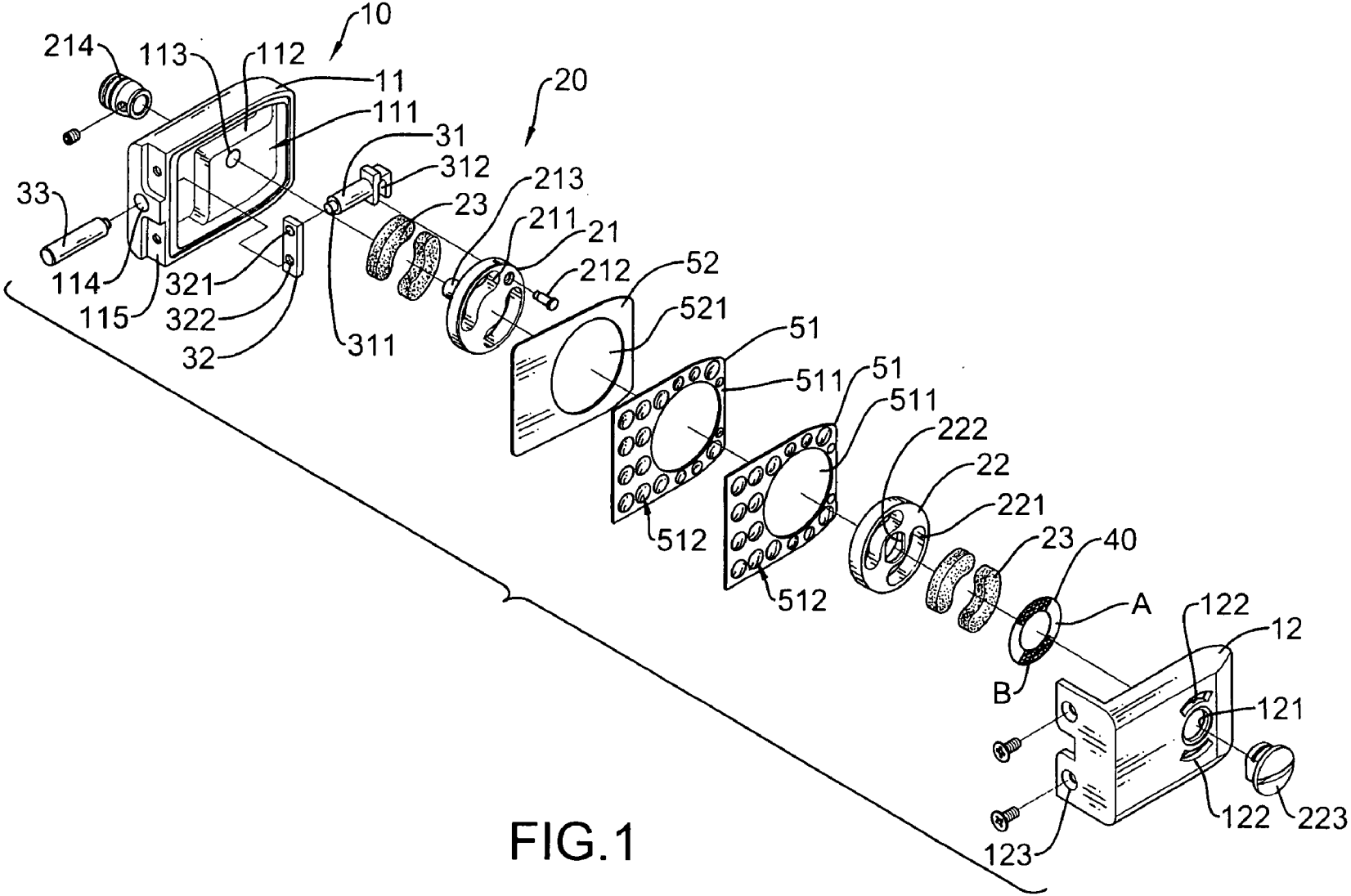
FIG. 1 is an exploded perspective view of an indicating lock in accordance with the present invention.

With reference to FIG. 1, an indicating lock for a rimless glass door in accordance with the present invention is composed of a seat assembly (10), a driving member (20), a latching member (30), an indicating ring (40), and a clamping member (50).

The seat assembly (10) is composed of an interior seat (11) and an exterior seat (12). The interior seat (11) has at least one recess (115) defined at a side thereof, and the exterior seat (12) has at least one finger (123) extending towards the interior seat (11) and received in the at least one recess (115). By fasteners inserted through the finger (123) and engaged in the interior seat (11), the interior seat (11) and the exterior seat (12) are assembled together. Viewed from the top, the seat (10) has a U-like shape, and a door (not shown in this figure) can be installed between the interior seat (11) and the exterior seat (12).

A first chamber (111) is defined in the interior seat (11) and at a side adjacent the door, and a channel (112) is defined in the first chamber (111) and adjacent a top side of the interior seat (11). A first hole (113) is defined through the interior seat (11) and beneath the channel (112). A latch hole (114) is transversally defined through the interior seat (11).

A second chamber (124) is defined in the exterior seat (12) and at a side adjacent the door, and a second hole (121) is defined through the exterior seat (12). At least one arcuate slot (122) is defined around the second hole (121). In this embodiment, two arcuate slots (122) are defined at two diametrically opposite sides of the second hole (121).

The driving member (20) has an interior driving disk (21) mounted in the interior seat (11), and an exterior driving disk (22) mounted in the exterior seat (12). The interior driving disk (21) has multiple first openings (211) defined therethrough, and multiple magnetic elements (23) are respectively received in the first openings (211). The exterior driving disk (22) has multiple second openings (221), and further multiple magnetic elements (23) are respectively received in the second openings (221).

In this embodiment, the interior driving disk (21) has two arcuate first openings (211) respectively defined at two diametrically opposite sides thereof, and the exterior driving disk (22) has two arcuate second openings (221) respectively defined at two diametrically opposite sides thereof. Four arcuate magnetic elements (23) are respectively received in the first and second openings (211, 221), wherein the polarities of the magnetic elements (23) in the first openings (211) and in the second openings (221) are opposite to each other. Therefore, under the magnetic force of the magnetic elements (23), the interior disk (21) and the exterior disk (22) respectively at two sides of the door can be turned with each other.

Figure 2:
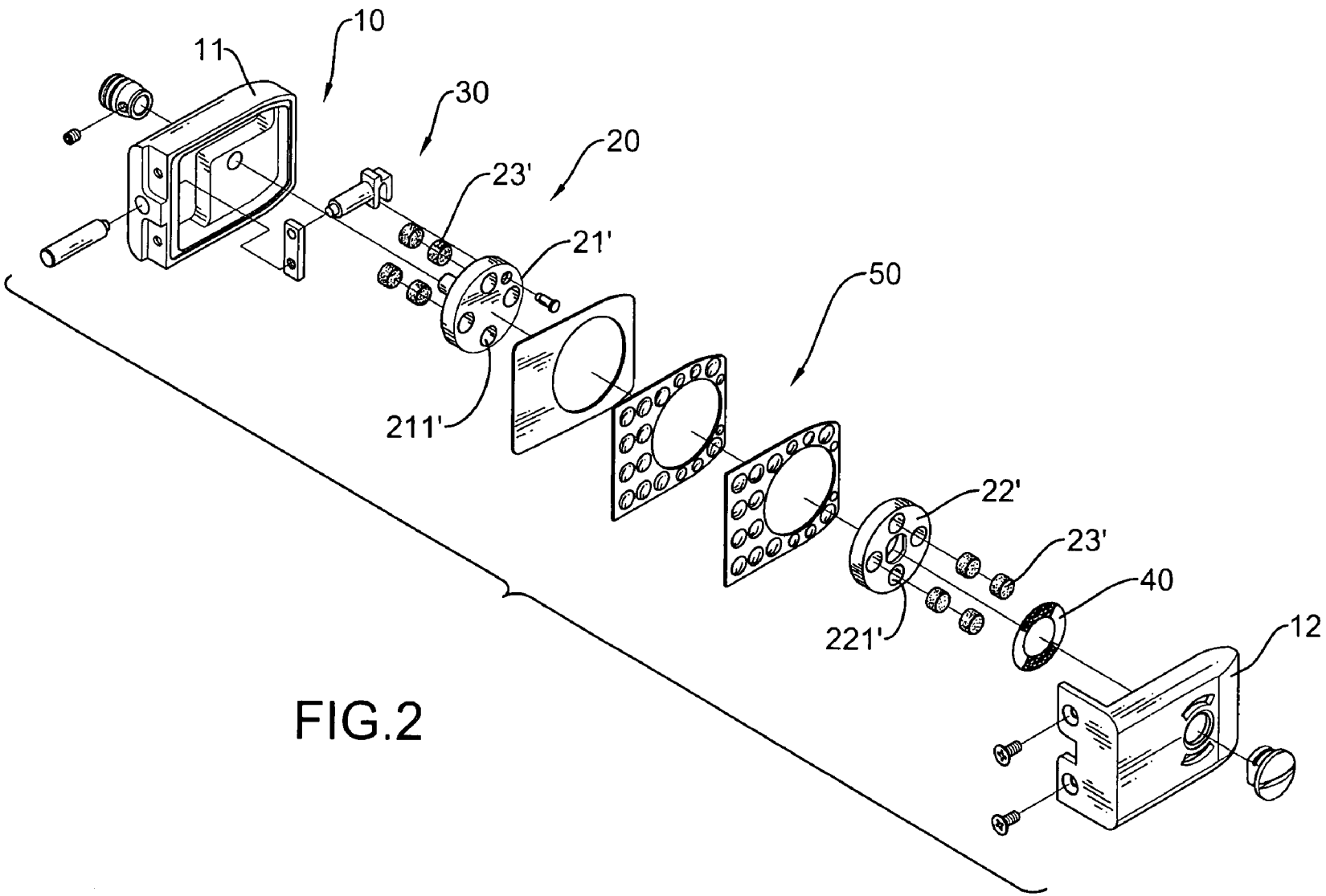
FIG. 2 is an exploded perspective view of another embodiment of the present invention.

In a second embodiment as illustrated in FIG. 2, the interior driving disk (21') has multiple circular openings (211') evenly defined therethrough, and the exterior driving disk (22') has multiple circular openings (221') evenly defined therethrough. Multiple circular magnetic elements (23') are respectively received in the first and second openings (211', 221'), wherein the polarities of the magnetic elements (23') in the first openings (211') and in the second openings (221') are opposite to each other.

With reference back to FIG. 1, a pin (212) is inserted through the interior driving disk (21), and a pole (213) is formed at a side of the interior driving disk (21) facing the first chamber (111) and extending through the first hole (113) of the interior seat (11). A knob (214) is fastened at a free end of the pole (213) out of from the interior seat (11). A third hole (222) is defined through the exterior driving disk (22), and a core (223) extends through the second hole (121) of the exterior seat (12) and secured in the third hole (222).

The latching member (30) is mounted in the interior seat (11), and has an inner latch (31) movably received in the channel (112). The inner latch (31) has a first end (311) adjacent the latch hole (114), and a notch (312) defined at a second end thereof away from the latch hole (114). The pin (212) in the interior disk (21) is positioned in the notch (312). An outer latch (33) movably extends through the latch hole (114) and connected with the inner latch (31) by a link (32). The link (32) has a first aperture (321), in which the first end (311) of the inner latch (31) is inserted, and a second aperture (322) beneath the first aperture (321), in which the outer latch (33) is inserted.

The indicating ring (40) is provided between the exterior disk (22) and the exterior seat (12) and aligned with the arcuate slots (122). The indicating ring (40) has at least two colors, symbols or words printed on a side facing the exterior seat (12) and visible from the arcuate slots (122). In this embodiment, two pairs of colored sectors, such as blue sectors (A) and red sectors (B), are evenly and alternatively provided at the side of the indicating ring (40) facing the exterior seat (12).

The clamping member (50) is composed of two clamping sheets (51) provided between the interior disk (21) and the exterior disk (22), and a pad (52) provided between the interior disk (21) and the adjacent clamping sheet (51) to cover the first chamber (111) of the interior seat (11). The clamping sheets (51) each have a first circular opening (511) defined therethrough, and the pad (52) has a second circular opening (521) aligned with the first circular openings (511). Multiple suckers (512) are formed on the clamping sheets (51) for abutting the glass door.

Figure 3:
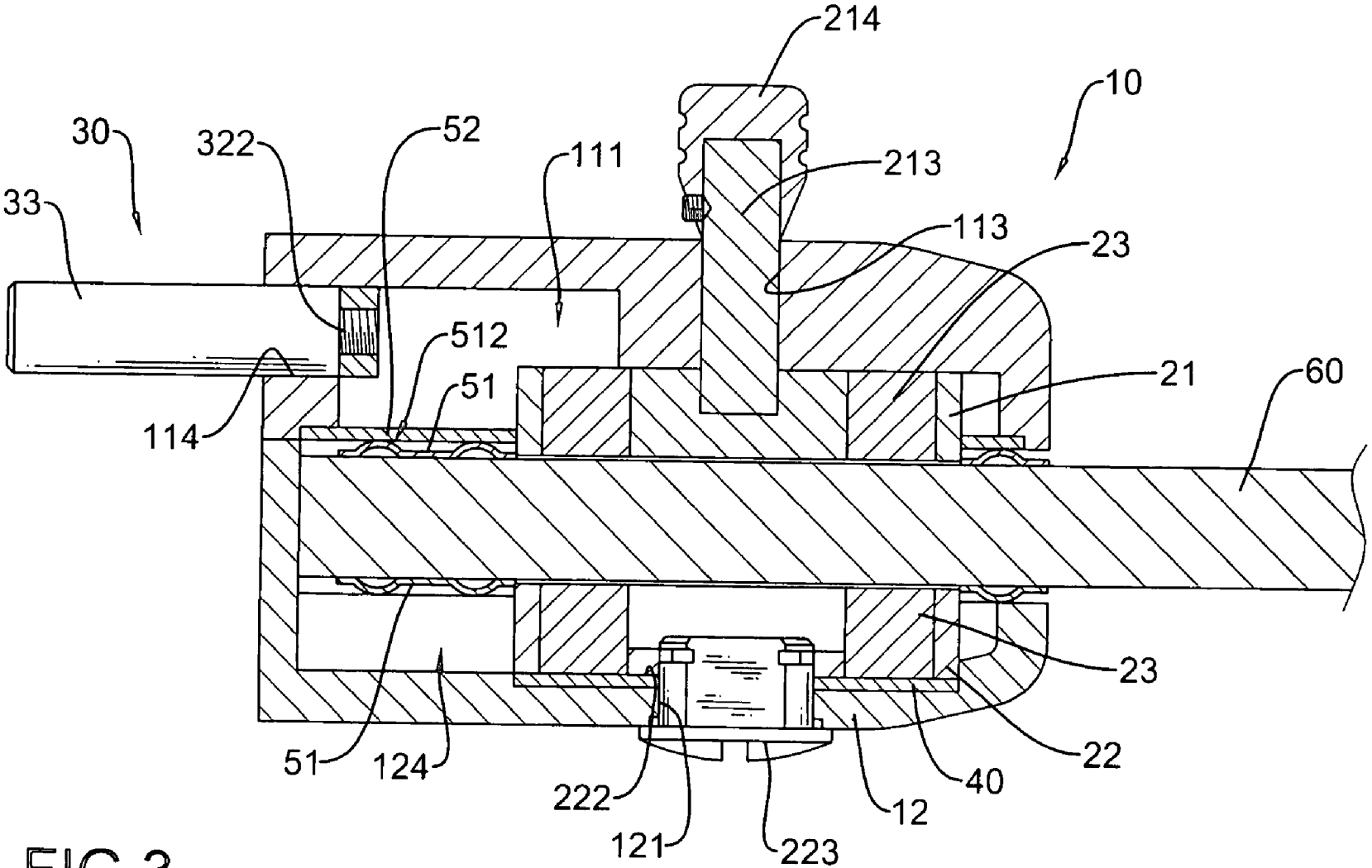
FIG. 3 is a top cross sectional view of the indicating lock in FIG. 1.
Figure 4:
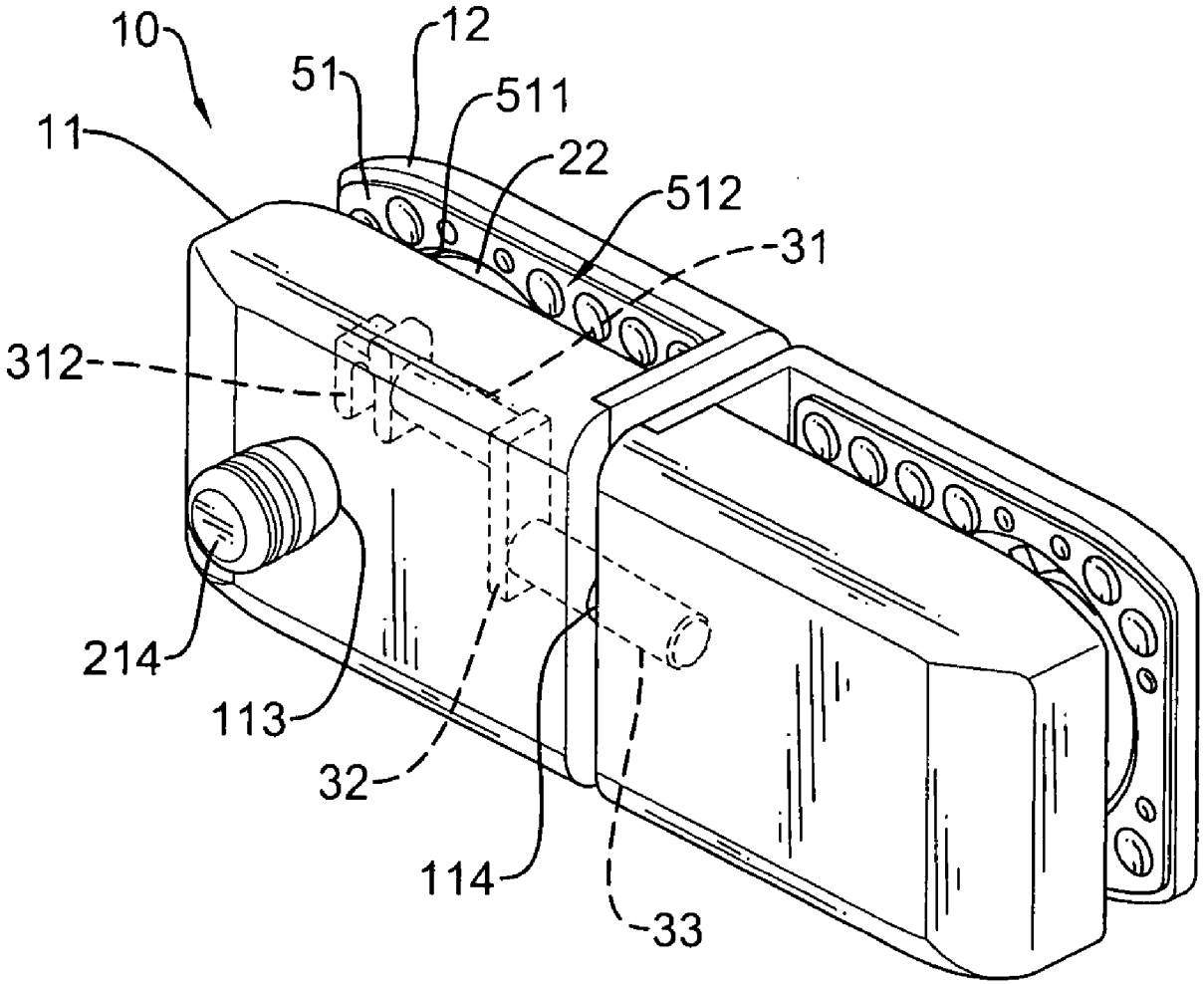
FIG. 4 is a perspective view of the indicating lock in FIG. 1 and a positioning seat.

In assembly, with reference to FIGS. 1, 3 and 4, the inner latch (31) is mounted on the link (32) by inserting the first end (311) in the first aperture (321) and received in the channel (112). Then, the outer latch (33) extends through the latch hole (114) and is inserted in the second aperture (322).

After the magnetic elements (23) are received in the interior disk (21), the pin (212) of the interior disk (21) is positioned in the notch (312) and the pole (213) is inserted through the first hole (113) for the knob (214) provided at the free end of the pole (213). The indicating ring (40) and the exterior disk (22) are in turn received in the second chamber (124), and the colored sheets (A, B) are exposed from the arcuate slots (122). The core (223) extends through the second hole (121) and is fastened in the third hole (222). Therefore, turning the core (223) can rotate the exterior disk (22).

The first chamber (111) is then covered with the pad (52), and one of the clamping sheets (51) is provided outside the pad (52). The interior disk (21) is received the second circular opening (521) of the pad (52) and the first circular opening (511) of the adjacent clamping sheet (51). The second chamber (124) is covered with the other clamping sheet (51). The exterior disk (22) is received in the first circular opening (511) of the adjacent clamping sheet (51).

Figure 5:
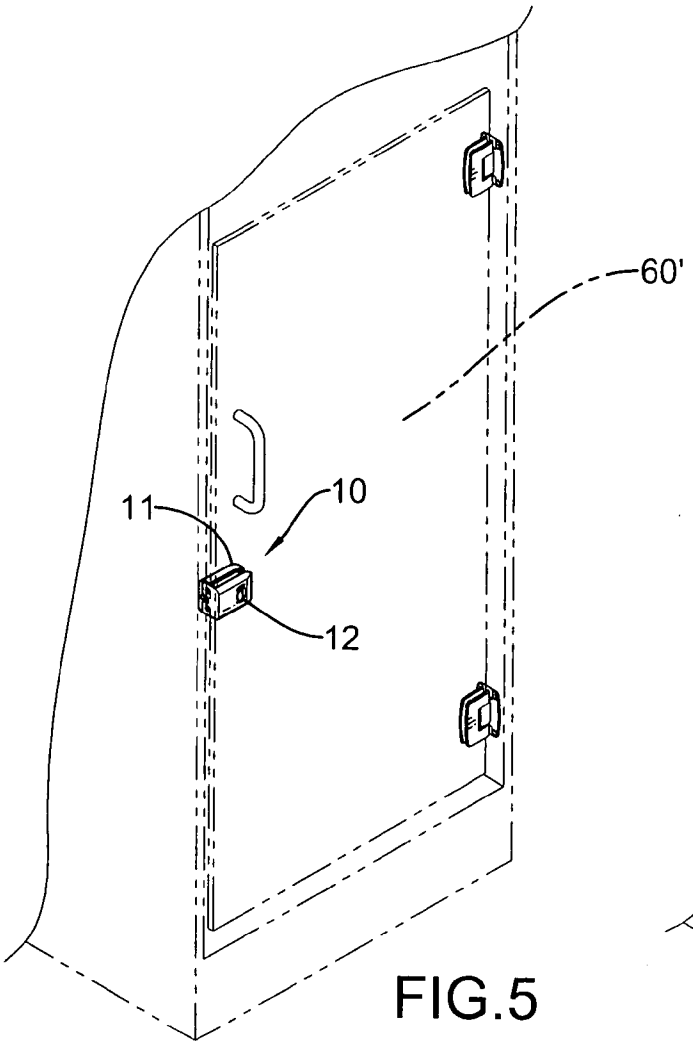
FIG. 5 is a schematic view of the indicating lock used for a rimless single glass door.

With reference to FIGS. 3 and 5, when the indicating lock is mounted on a rimless glass single door (60), the interior seat (11) and the exterior seat (12) are directly mounted at a side of the door leaf (60). By the suckers (512) of the clamping sheets (51) tightly adhering to the glass door (60), the indicating lock is securely fastened on the glass door (60) and will not freely move.

Figure 9:
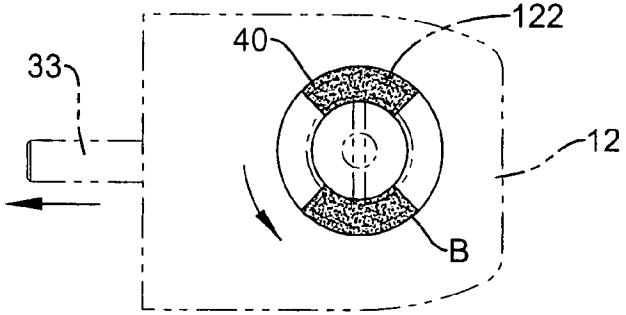
FIG. 9 is a schematic view of an indicating ring in an exterior seat in a locked status.
Figure 8:
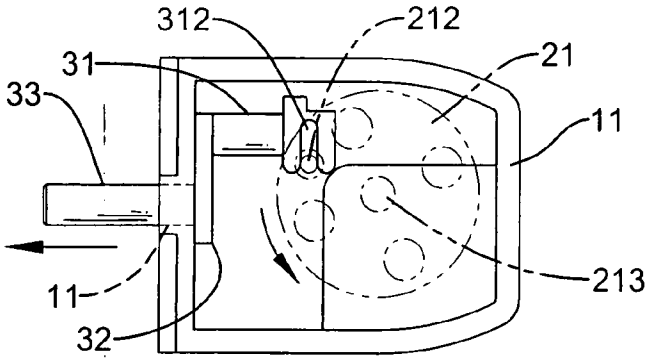
FIG. 8 is a schematic view of a locking member in an interior seat.

With reference to FIGS. 8 and 9, for locking the door, a user can turn the knob (214) to drive the pole (213). Then, the interior disk (21) is rotated, and the pin (212) is moved along with the interior disk (21). The inner latch (31) is driven by the pin (212) to transversally move in the channel (112), so the outer latch (33) is pushed to extend out of from the latch hole (114) and into a latch recess (not shown) defined at a side of a doorframe facing the outer latch (33). Thus, the glass door is locked.

Under the force of the magnetic elements (23), the exterior disk (22) and the indicating ring (40) are turned along with the interior disk (21). When the outer latch (33) is positioned in the latch recess, the red sectors (B) are respectively aligned with the arcuate slots (122), so that any person outside the door can see the red sectors (B) and so is aware that the door is locked.

Figure 11:
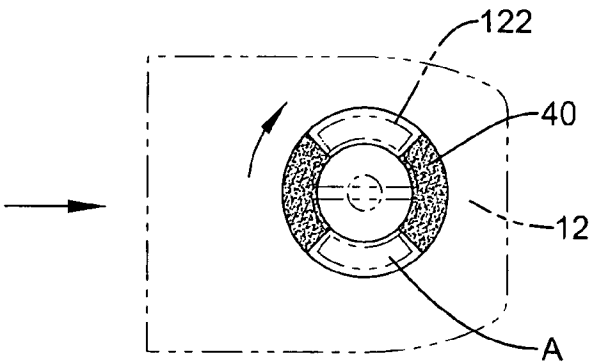
FIG. 11 is a schematic view of an indicating ring in an exterior seat in an unlocked status.
Figure 10:
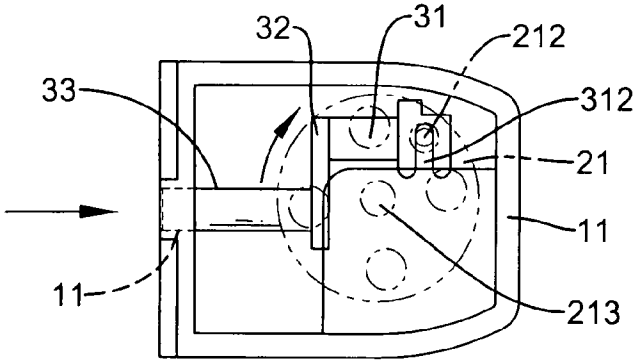
FIG. 10 is a schematic view of a locking member in an interior seat in an unlocked status.

With reference to FIGS. 10 and 11, to unlock the door, the knob (214) is reversedly turned to rotate the interior disk (21). The inner latch (31) is driven by the pin (212) to transversally move back in the channel (112), so the outer latch (33) is pulled back and retracted from the latch recess. Thus, the glass door is unlocked.

Under the force of the magnetic elements (23), the exterior disk (22) and the indicating ring (40) are reversedly turned along with the interior disk (21). When the outer latch (33) is retracted from the latch recess, the blue sectors (A) are respectively aligned with the arcuate slots (122), so that any person outside the door can see the blue sectors (A) and so is aware that the door is unlocked.

Figure 6:
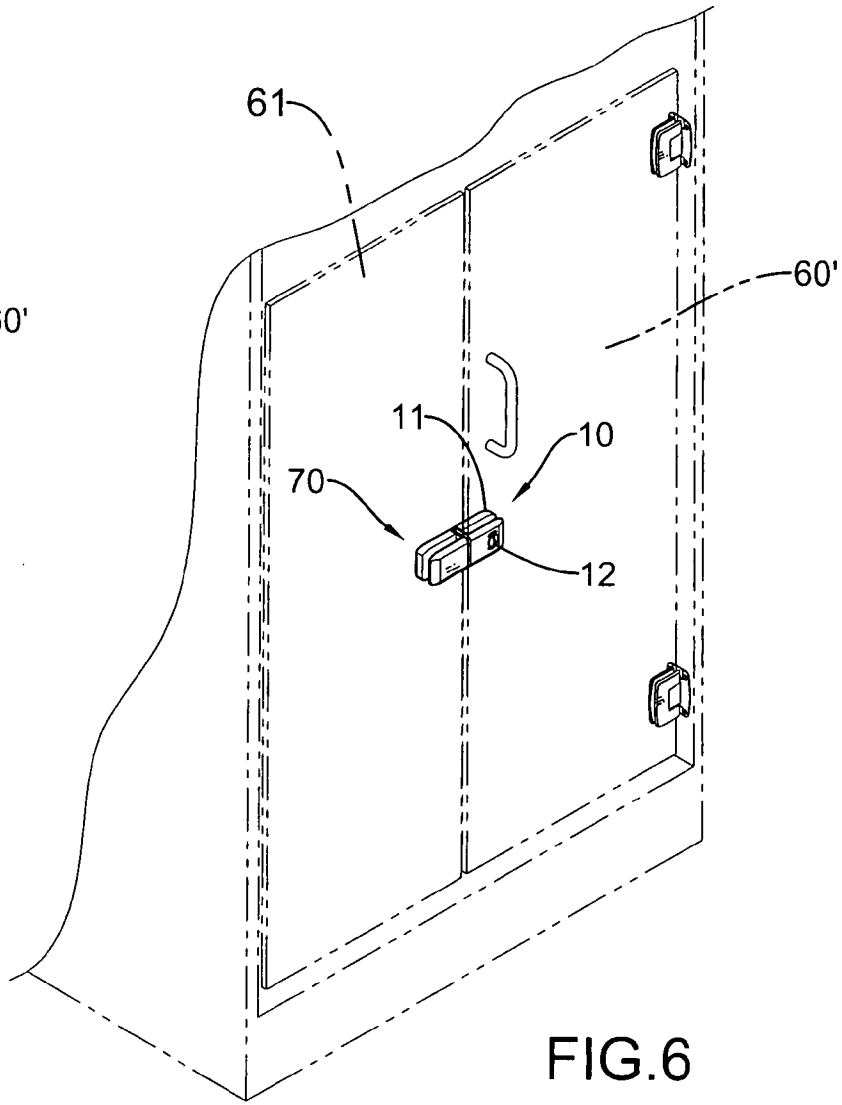
FIG. 6 is a schematic view of the indicating lock used for a rimless double glass door.

With reference to FIGS. 4 and 6, a rimless glass double door with two door leaves (60', 61) is shown. The interior seat (11) and the exterior seat (12) are mounted at the side of the first door leaf (60'), and a positioning seat (61) is mounted at a side of the second door leaf (61) adjacent the first door leaf (60').

Figure 7:
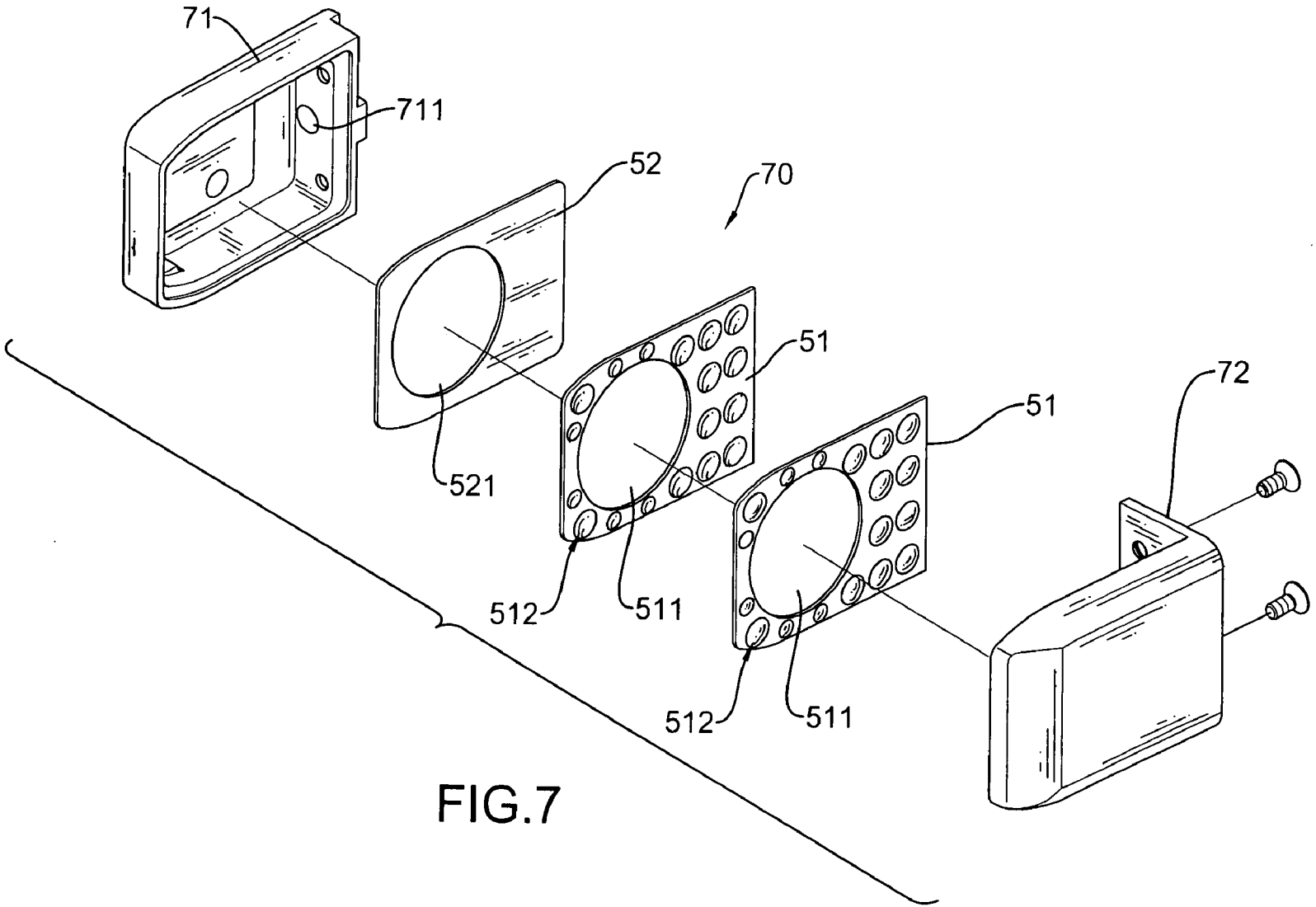
FIG. 7 is an exploded perspective view of the positioning seat in FIG. 4.

With reference to FIGS. 4 and 7, the positioning seat (70) is composed of a second interior seat (71) and a second exterior seat (72) fastened together by fasteners (not numbered). Viewed from the top, the positioning seat (70) has a U-like shape symmetrical to the indicating lock. A second latch hole (711) is transversally defined through a side of the second interior seat (71) facing the latch (33) and in alignment with the latch hole (114). The pad (52), and two clamping sheets (51) are in turn provided between the second interior and exterior seats (71, 72). The second door leaf (61) is then securely clamped between the two clamping sheets (51).

The locking and unlocking manners are the same as the manners for the glass door with one door leaf except that the outer latch (33) is not received in/retracted from the latch recess in the doorframe but instead is received in/retracted from the second latch hole (711).

Because the indicating lock eliminates an axle extending through the door, the indicating lock can be easily installed on the door without cutting glass of the door. Furthermore, it is also very convenient for those outside the door to know by observing the indicating ring (40) whether the door is locked. Moreover, the door is locked by the magnetic force, so it is very easy to unlock the indicating lock by turning the core (223) in an emergency.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An indicating lock for a rimless glass door comprising:

a seat assembly having an interior seat with at least one recess defined at a side of the interior seat, a first chamber defined in the interior seat, a first hole defined through the interior seat and a latch hole transversally defined through the interior seat, and an exterior seat with at least one finger extending towards the interior seat and fastened in the at least one recess by fasteners, a second chamber defined in the exterior seat, a second hole defined through the exterior seat and at least one arcuate slot defined around the second hole;

a driving member having an interior disk received in the first chamber, a pole formed on the interior disk and extending through the first hole, an exterior disk received in the second chamber, a core inserted though the second hole and mounted in the exterior disk, multiple magnetic elements respectively received in the interior disk and the exterior disk, wherein polarities of the magnetic elements in the interior disk and the exterior disk are opposite to each other;

a locking member having an inner latch movably received in the first chamber and driven by the interior seat, and an outer latch connected with the inner latch and extending though the latch hole; and an indicating ring mounted at a side of the exterior disk facing the exterior seat, the indicating ring printed with at least two different marks corresponding to the at least one arcuate slot.

2. The indicating lock as claimed in claim 1 further comprising two clamping sheets provided between the interior seat and the exterior seat, each clamping sheet having a first circular opening for receiving the interior/exterior seat, and multiple suckers formed on the respective clamping sheet.

3. The indicating lock as claimed in claim 2 further comprising a pad provided between the interior seat and the adjacent clamping sheet, the pad having a second circular opening for receiving the interior seat.

4. The indicating lock as claimed in claim 1, wherein the interior seat has a channel transversally defined in the first chamber, the inner latch is received in the channel, and the outer latch is connected with the inner latch by a link.

5. The indicating lock as claimed in claim 1, wherein the exterior seat has two arcuate slots defined at two diametrically opposite sides of the second hole; and two pairs of colored sectors are evenly and alternatively provided at the side of the indicating ring facing the exterior seat.

6. The indicating lock as claimed in claim 1, wherein the interior seat has a pin inserted therethrough and positioned in the inner latch.

7. The indicating lock as claimed in claim 1 further comprising a knob provided at a free end of the pole extending out of from the interior seat.

8. The indicating lock as claimed in claim 1, wherein the interior disk has two first arcuate openings defined through the interior disk, the exterior disk has two second arcuate openings defined through the exterior disk, and four arcuate magnetic elements are respectively received in the first and second arcuate openings.

9. The indicating lock as claimed in claim 1, wherein the interior disk has multiple first circular openings defined through the interior disk, the exterior disk has multiple second circular openings defined through the exterior disk, and multiple circular magnetic elements are respectively received in the first and second circular openings.

* * * * *